US006702605B2

(12) United States Patent
Chung Long Shan

(10) Patent No.: US 6,702,605 B2
(45) Date of Patent: Mar. 9, 2004

(54) Z-SHAPED INSULATION DISPLACEMENT CONTACT

(75) Inventor: Laval Chung Long Shan, Watanobbi (AU)

(73) Assignee: Krone GbmH, Berlin-Zehlendorf (DE)

( * ) Notice: Subject to any disclaimer, the term of this patent is extended or adjusted under 35 U.S.C. 154(b) by 0 days.

(21) Appl. No.: 10/257,412

(22) PCT Filed: Mar. 29, 2001

(86) PCT No.: PCT/EP01/03582

§ 371 (c)(1),
(2), (4) Date: Oct. 9, 2002

(87) PCT Pub. No.: WO01/78193

PCT Pub. Date: Oct. 18, 2001

(65) Prior Publication Data

US 2003/0054685 A1 Mar. 20, 2003

(30) Foreign Application Priority Data

Apr. 11, 2000 (AU) ..... PQ 6843

(51) Int. Cl.[7] ..... H01R 4/24
(52) U.S. Cl. ..... 439/404

(58) Field of Search ..... 439/403, 402, 439/404, 395, 412, 417, 406

(56) References Cited

U.S. PATENT DOCUMENTS 4,533,196 A * 8/1985 Forberg et al. ..... 439/404
5,653,608 A * 8/1997 Saligny ..... 439/404
5,863,215 A * 1/1999 Debbaut et al. ..... 439/412

* cited by examiner

*Primary Examiner*—Tulsidas Patel
*Assistant Examiner*—Phuong Dinh
(74) *Attorney, Agent, or Firm*—McGlew and Tuttle, P.C.

(57) ABSTRACT

Insulation displacement contact (20) having a conductive element (22) with an aperture (24). Contact portions (32) defined by parts of the edge of the aperture (24) converge towards each other and have opposed contact edges (32*c*) between which is defined a channel (42). Wires (48) introduced into an enlarged portion (24*a*) of the aperture (24) can be laterally moved into the channel (42) to cut insulation of the wire (48) and make electrical connection between a conductor (52) of the wire and the contact edges (32*c*). To improve stability, the contact element (22) has, at opposite edges, oppositely directed flanges (46, 48).

9 Claims, 6 Drawing Sheets

Z-SHAPED INSULATION DISPLACEMENT CONTACT

This invention relates to an insulation displacement contact.

Australian Patent specification 90449/98 describes an electrical power outlet having insulation displacement contacts for connecting insulated wire thereto. More particularly, there is described an insulation displacement contact formed from a conductive element having an aperture therein, opposed portions of the edge of the aperture defining opposed contact portions which extend inwardly towards each other and which have inner opposed contact edges which define a channel therebetween, whereby a wire having a conductor surrounded by insulation may be introduced into the channel and pressed into the channel to cut the insulation of the wire and make electrical contact between the contact edges and the conductor.

In the arrangement as last-described, a carrier may be provided, slidable with respect to the conductive element and having an opening into which the wire may be introduced such that the wire extends into the opening and also through the aperture at a portion of the aperture spaced from the channel, the wire then being movable into the channel to make said contact by sliding the carrier to carry the wire into the channel.

In an arrangement as described in patent specification 90449/98, it has been found that there is some tendency for the conductive element to buckle when a wire is terminated, unless the conductive element is made from relatively heavy material.

In one aspect, the invention provides an insulation displacement contact formed from a conductive element having an aperture therein, opposed portions of the edge of the aperture defining opposed contact portions which extend inwardly towards each other and which have inner opposed contact edges which define a channel therebetween, whereby a wire having a conductor surrounded by insulation may be introduced into the channel and pressed into the channel to cut the insulation of the wire and make electrical contact between the contact edges and the conductor; the insulation displacement contact having, at opposed side edges of the conductive element, respective flanges which are generally parallel to the direction of extent of said channel and which are oppositely directed with respect to each other. Particularly, the conductive element may define a central portion which is elongate in the direction of extent of said channel, and said flanges may extend in said direction and out of the plane of the central portion to respective opposite sides of that plane.

The contact portions may extend from substantially fixed ends at an angle to the direction of extent of the channel so as to converge towards each other, and have free end parts which extend generally parallel to each other and which define said contact edges. Free end edges of said free end parts may extend transversely with respect to the direction of extent of said channel and diverge outwardly with respect to each other in the direction away from said substantially fixed ends to form a lead-in structure for facilitating entry of the wire into the channel. The free end edges may extend angularly with respect to said plane of the central portion and be oppositely directed with respect to that plane so as to tend to introduce displacement of the contact portions in opposite rotational directions out of said plane, when a wire is brought into contact with the free end edges for introduction into said channel.

The invention is further described by way of example only with reference to the accompanying drawings in which.

Figure 1:
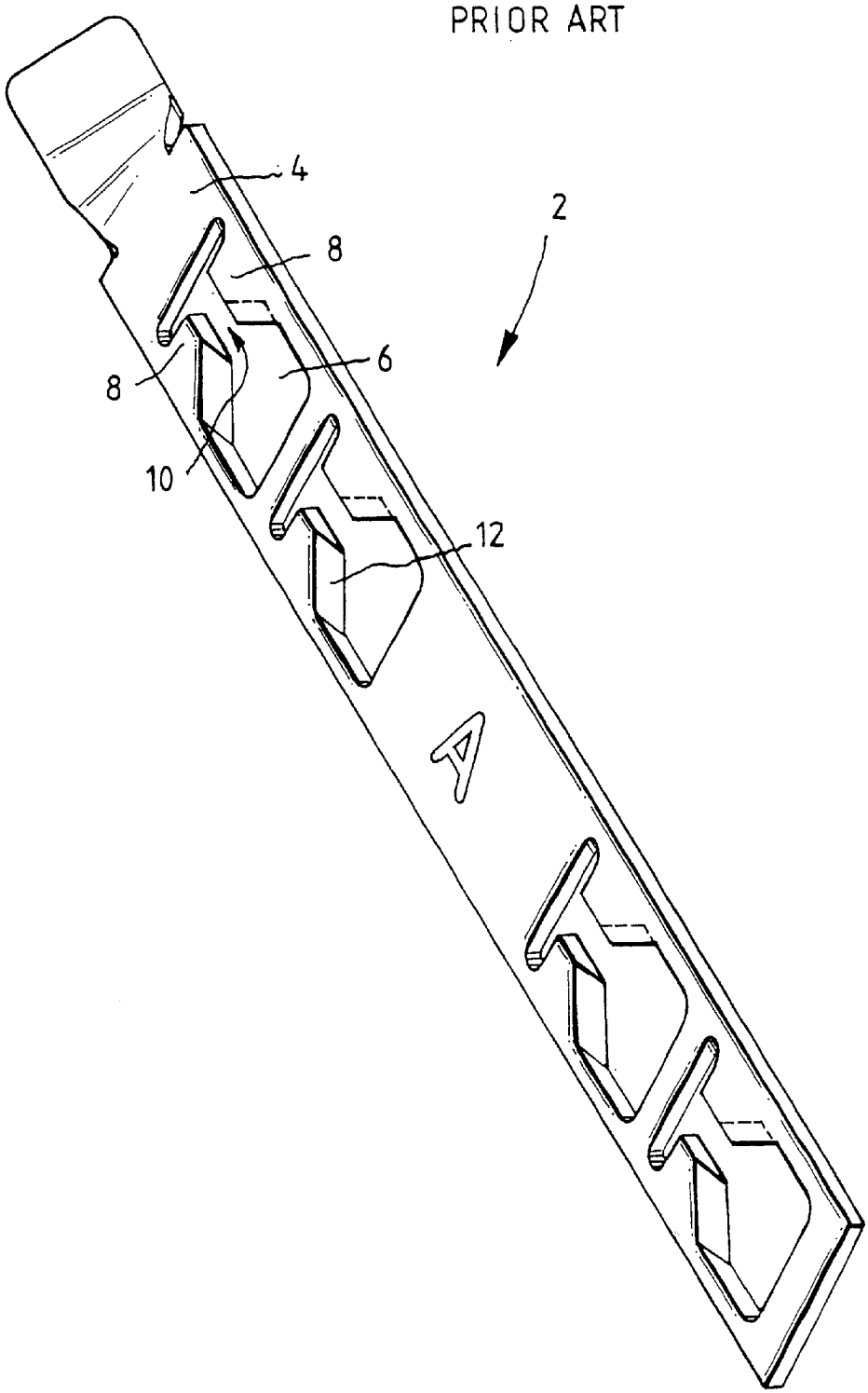
FIG.1 PRIOR ART
FIG. 1 is a perspective view of a prior art insulation displacement contact.
Figure 2:
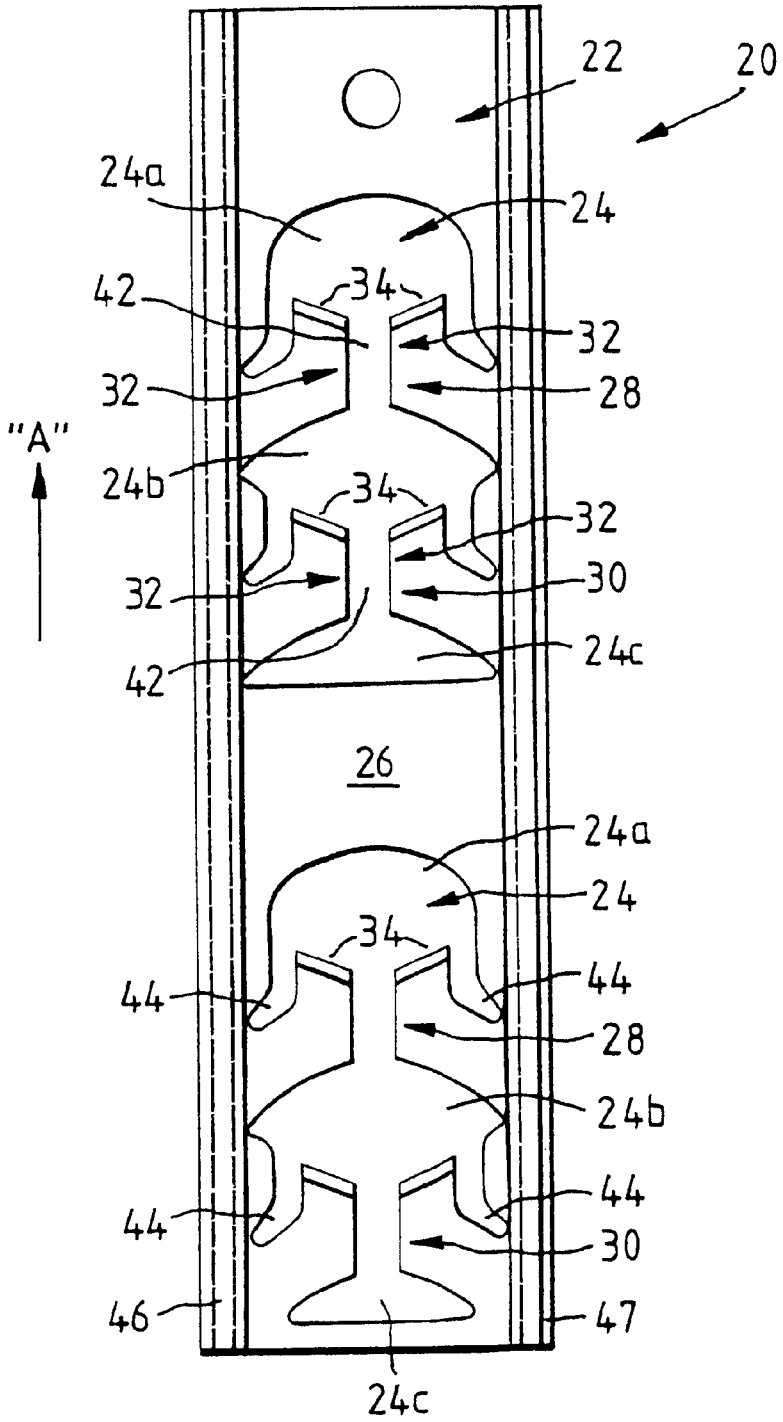
FIG. 2 is a front view of an insulation displacement contact constructed in accordance with the invention.

The insulation displacement contact 2 shown in FIG. 1 comprises an elongate generally planar conductive element 4 having a series of apertures 6 spaced along the length thereof. The edge of each aperture 6 defines a pair of inwardly projecting contact portions 8 which define therebetween a relatively narrow channel 10. Wires introduced into the apertures 6 by lengthwise movement of the wires transverse to the element 4 may be moved laterally, and lengthwise of the element 8, to enter these into a channels 10 so that opposed contact edges of the portions 8 contact the wires, cut the insulation thereof and make electrical connection to inner conductors of the wires. To facilitate leading of the wire into the channel, the portions 8 may have respective leading edges 12, and these may, as shown, the oppositely inclined with respect to the plane of the element. By this, when a wire is engaged with the edges 12 during introduction of the wire into the channel 10, torsional displacement of the portions 8 relative to the lengthwise direction of the element 4 occurs. By this, the portions 8 are oppositely displaced relative to the plane of the element 4.

The insulation displacement contact 20 of FIGS. 2 to 9 is formed from a conductive element 22 of laminar form, being generally planar. Apertures 24 are spaced along the length of the element 22, these extending through a central portion 26 of the element 22, and being spaced in the lengthwise direction of extent of the element 22. In this case, there are two apertures 24, each configured to define two respective contact structures 28, 30, the contact structures 28, 30 of each aperture 24 being spaced in the lengthwise direction of extent of the element 22. Since the two apertures 24 and associated contact structure 28, 30 are substantially the same, the following description is confined to one of these apertures and associated contact structures.

Figure 3:
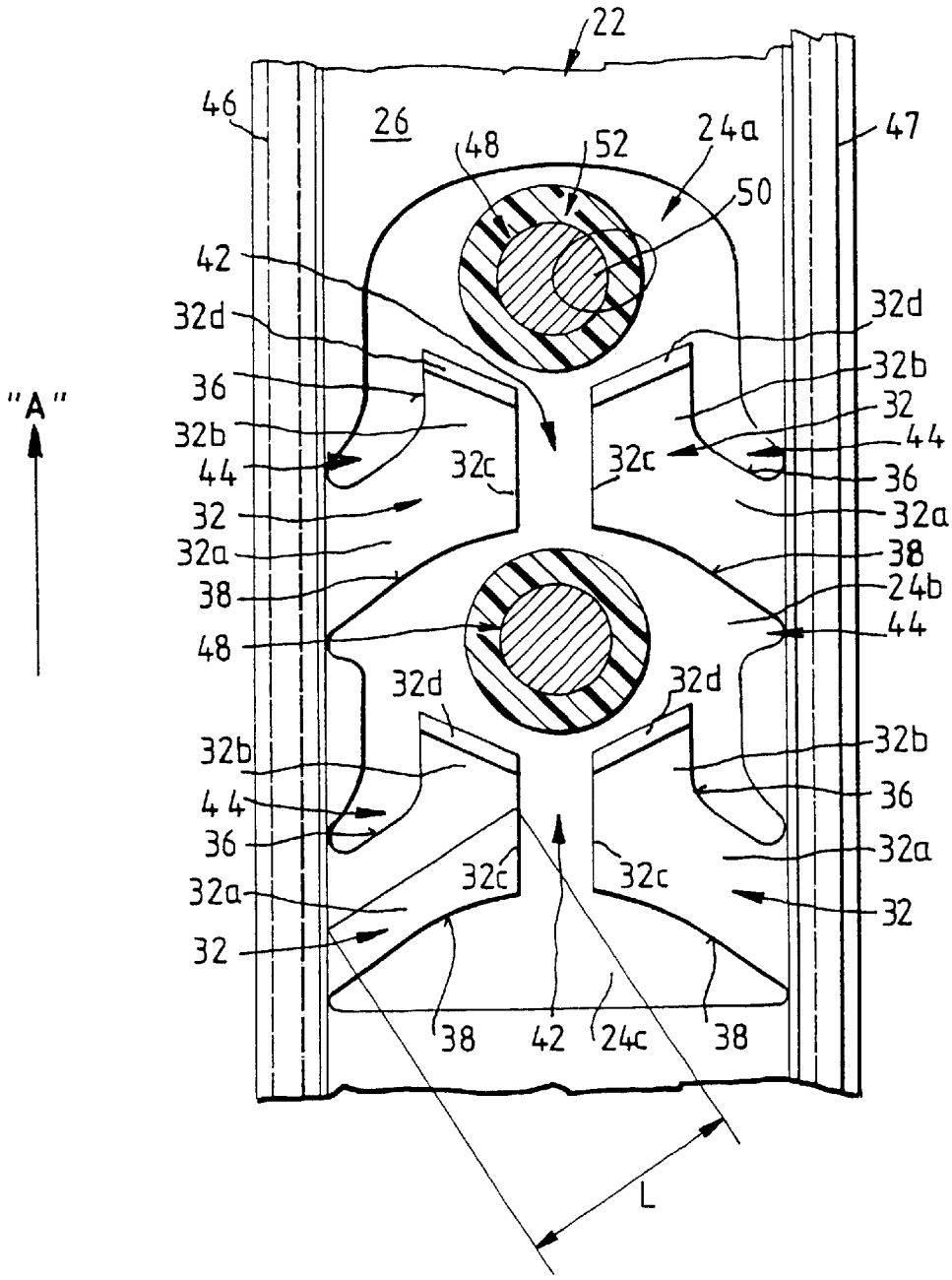
FIG. 3 is an enlarged fragmentary view of portion of FIG. 2 and illustrating how wires are brought into contact with the insulation displacement contact.
Figure 4:
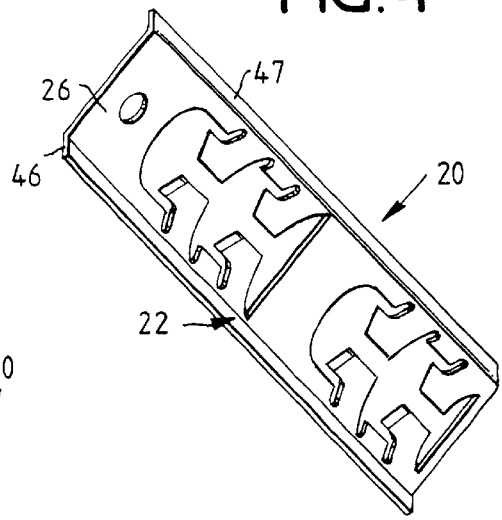
FIG. 4 is a perspective view of the insulation displacement contact of FIG. 2.
Figure 5:
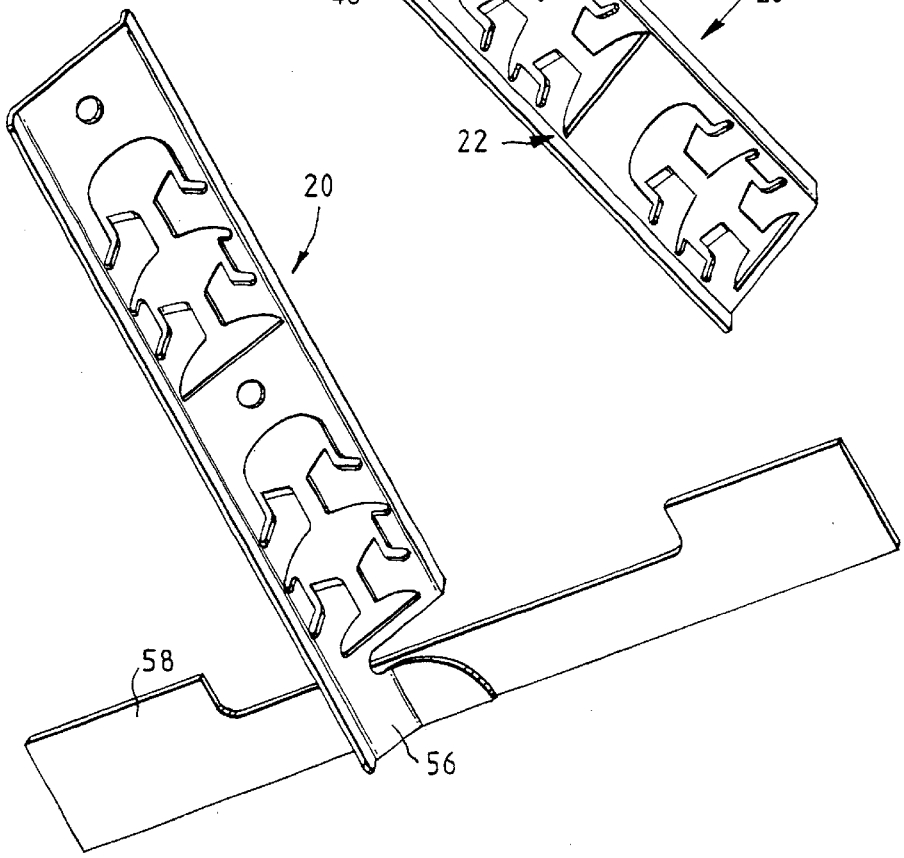
FIG. 5 is another perspective view of the insulation displacement contact of FIG. 4.

As best shown in FIG. 3, each of the contact structures 28, 30 has a pair of contact portions 32 defined by the edge of the associated aperture 24, and which extend inwardly towards each other from opposite sides of the element 22. Each pair of contact portions 32 defines therebetween a respective channel 42. Each contact portion 32 has a part 32*a* which extends from a respective substantially fixed end adjacent a respective edge of the element 22, being angularly disposed with respect to the lengthwise direction of extent of the element 22, which direction is marked "A" in the drawings. Parts 32*a* of each pair of contact portions 32 converge towards each other in direction "A". At outer ends of the contact portions 32, free end parts 32*b* are defined, these extending somewhat parallel to the direction "A" and defining at inner edges thereof contact edges 32*c*. The contact edges 32*c* on each pair of contact portions 32 define therebetween a respective one of the channels 42. At free ends of the contact parts 32*b*, there are provided transverse free end edges 32*d* which diverge away from each other in the direction "A", and these define a respective lead-in structure 34 (FIG. 2) for facilitating entry of wires into the associated channel 42. As shown, these edges 32*d* are defined by inclined surfaces, the surfaces being oppositely inclined with respect to the plane of the element 22 so that, when a wire is introduced into a channel structure 42, as presented by a pair of edges 32*d*, there is a tendency for the respective contact portions 32 to be relatively oppositely rotated relative to the lengthwise direction of the contact element 22, and to be displaced to respective opposite sides of the plane of the element 22.

Each channel 42 leads, in the direction "A", away from the fixed ends of the contact portions 32 to an enlarged portion 24*a*, 24*b* of the respective aperture 24. That is, there is an enlarged aperture portion 24*a* adjacent the channel 42 for the contact structure 28, at one end of the aperture 24, and a similar enlarged aperture portion 24*b* adjacent the contact structure 30, at the other end of aperture 24.

The aperture portions 24*a*, 24*b* also define, at opposite sides thereof, cut-out aperture parts 44 which diverge outwardly in the direction opposite to direction "A". These define edges 36 of the contact portions 32. As a result, as compared with the arrangement shown in FIG. 1, it will be observed that the contact portions 32 are relatively longer ("dimension "L" in FIG. 3) and of lesser width, and thus exhibit somewhat greater flexibility than exhibited by the contact elements 8 in FIG. 1.

Edges 38 of the contact portions 32 of contact structure 28, opposite edges 36 thereof, are defined by portion of the periphery of aperture portion 24*b*. These edges 38 are disposed transversely with respect to the direction of extent of the element 22, and converge in the direction "A". Edges 38 of the contact portions 32 of the contact structure 30 are defined by another portion of the periphery of a further portion 24*c* of the aperture 24. These edges 38 are likewise disposed transversely with respect to the direction of extent of the element 22, and converge in the direction "A".

FIG. 3 shows insulated wires 48 having internal conductors 50 surrounded by insulation 52. The portions 24*a*, 24*b* of the aperture 24 are large enough to freely accommodate respective ones of these wires 48, as shown, such that these wires extend normally to the plane of the central portion 26 of element 22. Once in position as shown in FIG. 3, the wires may be moved in the direction opposite direction "A" to pass them into the channels 42 to cut the insulation 52 and make electrical connection between the contact edges 32*c* of the contact portions 32 and the conductors 50, in a similar way to that described in FIG. 1.

Further to improved effectiveness of operation, the element 22 has, at opposed longitudinal edges thereof, flanges 46, 47. As shown, these are directed oppositely with respect to the plane of a central portion 26 of the element 22 so as to be one to either side of that plane. Also, as shown, these extend at an angle of approximately 45° to the plane of the central portion 26, as viewed in section transverse to the direction of extent of the element 22. The flanges 46, 47 strengthen the element 22, and facilitate effective connection to the wires.

Figure 6:
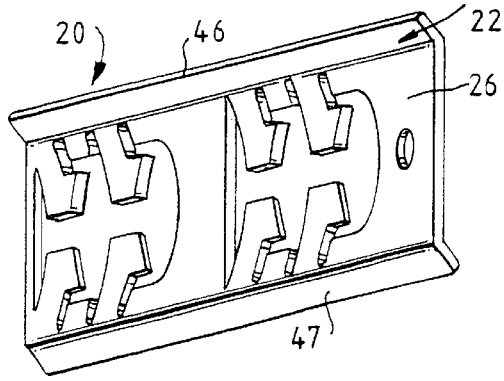
FIG. 6 is a perspective view of the insulation displacement contact of FIG. 2, connected to a conductive element.

As shown in FIG. 6, the contact 20 may be connected by a suitable end portion 56 to other conductors such as the conductor 58 shown, for use in applications such as described in the mentioned Australian patent specification where connection to other circuit elements is required.

Figure 7:
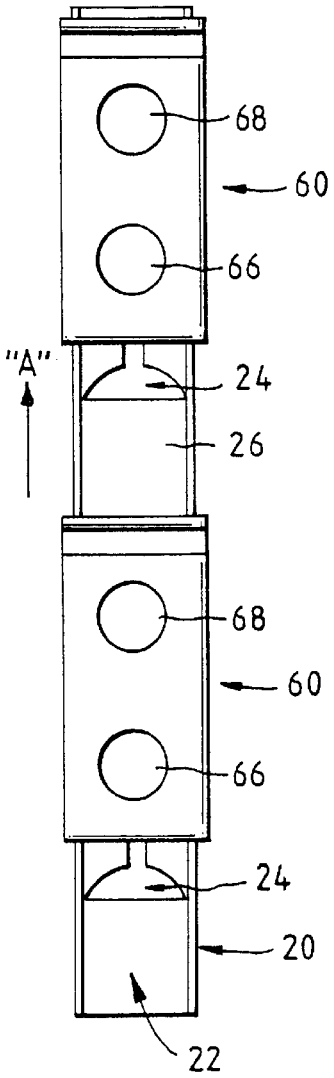
FIG. 7 shows the insulation displacement connector of FIG. 2 coupled to wire carriers.
Figure 8:
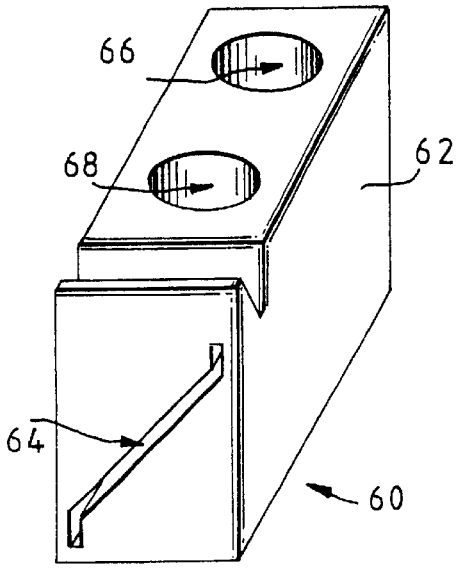
FIG. 8 is a perspective view of one of the wire carriers of FIG. 7.

Also, as shown in FIG. 7, slidable carriers 60 may be fitted to the contact element 20. In the case of FIG. 7, there are two such carriers 60, one associated with each aperture 24. Each carrier 60 is formed as a body 62 formed of electrically insulative material with a lengthwise extending slot 64 therethrough, which neatly slidably accommodates the element 22, for slidable movement of the carriers 60 therealong. Each carrier 60 has two openings 66, 68, these extending generally parallel to the flanges 46, 47 and thus at an angle of 45° to the central portion 26 of the contact element 22. Each carrier 60, and the openings 66, 68 therethrough, are arranged so that, in respective first positions of the carriers, the openings 66, 68 are arranged in alignment with the portions 24*a*, 24*b* of the respective apertures 24 in the element 22. In this condition, wires may be introduced into the carriers so as to pass through the respective openings 66, 68 and into the portions 24*a*, 24*b* of the apertures. Thereafter, by sliding movement of the carriers 60 in the direction opposite to direction "A", as viewed in FIG. 7, the wires are forced between the channels 42 for making electrical connection as described.

Figure 9:
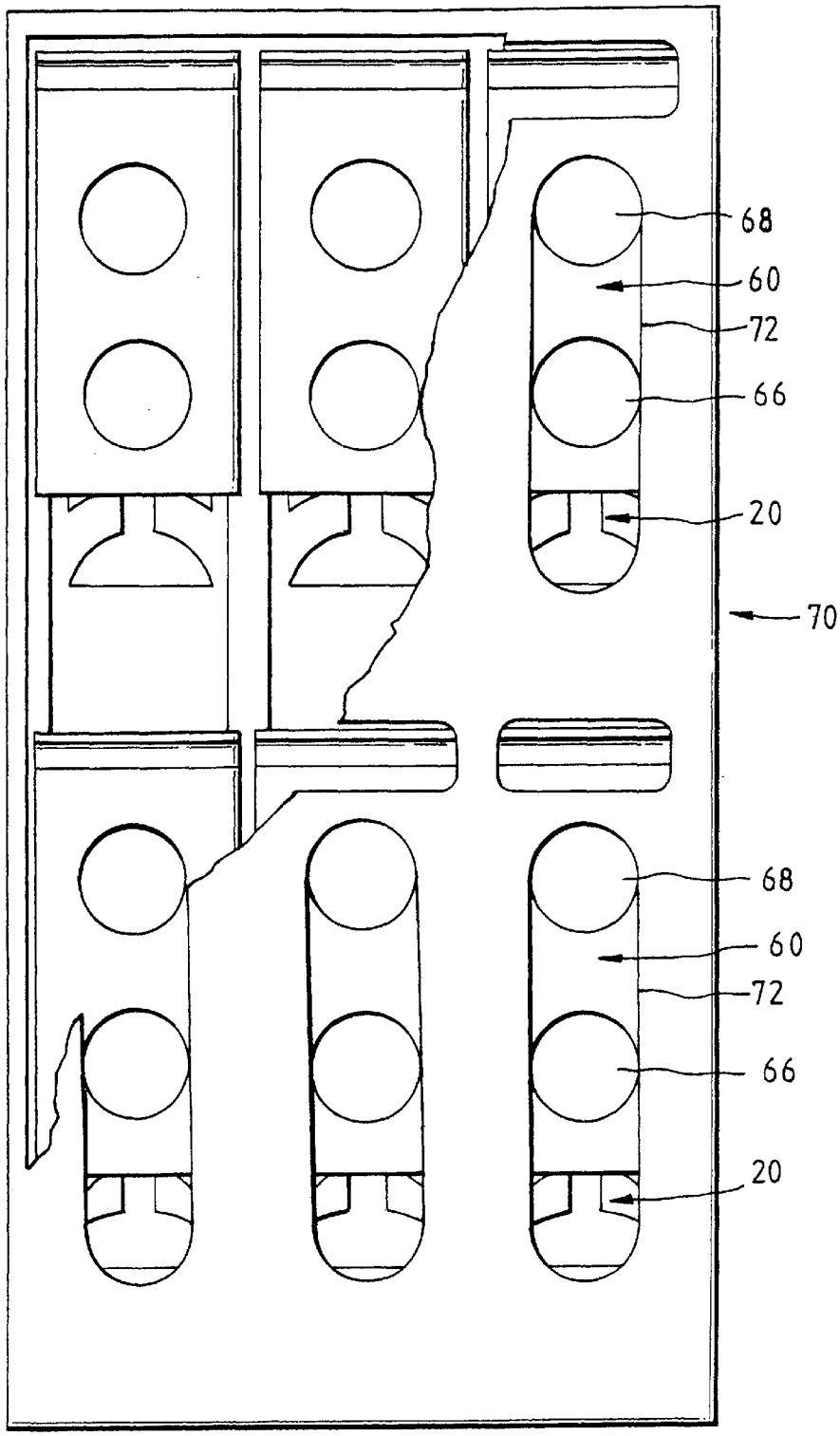
FIG. 9 is a rear view of an electrical power socket fitted with electrical connectors and wire carriers as shown in FIG. 7.

FIG. 9 shows an arrangement where a plurality of contacts 20 are contained within a casing 70 having respective openings associated with carriers 60 of which there are two carriers 60 for each contact 20, as shown in FIG. 7. The casing has slots 72 so that, when the carriers 60 are in positions for receipt of wires (as shown in FIG. 9), the openings 68 of the carriers are positioned at one ends of the respective slots 72. The slots 72 are of sufficient length to enable the carriers 60 to be moved to make electrical connection as described, by movement so that the other opening 66 of each is then positioned at the opposite end of the respective slot 72.

The casing 70 may for example form part of an electrical power outlet as described in Australian Patent Application No. 90449/98.

The described arrangement has been advanced merely by way of explanation any many modifications may be made thereto without departing from the spirit and scope of the invention which includes every novel feature and combination of novel features herein disclosed.

A listing of parts follows:

| | |
|---|---|
| Insulation displacement contact | 2 |
| Conductive element | 4 |
| Apertures | 6 |
| Projecting contact portions | 8 |
| Channel | 10 |
| Leading edges | 12 |
| Insulation displacement contact | 20 |
| Conductive element | 22 |
| Apertures | 24 |
| Aperture portions | 24a, 24b, 24c |
| Central portion | 26 |
| Contact structures | 28, 30 |
| Contact portions | 32 |
| Contact parts | 32a |
| Contact free end parts | 32b |
| Contact edges | 32c |
| Free end edges | 32d |
| Lead-in structure | 34 |
| Contact edges | 36, 38 |
| Channel | 42 |
| Aperture parts | 44 |
| Flanges | 46, 47 |

-continued

| | |
|---|---|
| Insulated wires | 48 |
| Internal conductor | 50 |
| Insulation | 52 |
| Contact end portion | 56 |
| Conductor | 58 |
| Carriers | 60 |
| Body | 62 |
| Slot | 64 |
| Openings | 66, 68 |
| Casing | 70 |
| Slot | 72 |

This specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

What is claimed is:

1. An insulation displacement contact comprising:

a conductive element having an aperture therein, opposed portions of the edge of the aperture defining opposed contact portions which extend inwardly towards each other and which have inner opposed contact edges which define a channel therebetween, whereby a wire having a conductor surrounded by insulation may be introduced into the channel and pressed into the channel to cut the insulation of the wire and make electrical contact between the contact edges and the conductor, the insulation displacement contact having, at opposed side edges of the conductive element, respective flanges which are generally parallel to the direction of extent of said channel and which are oppositely directed with respect to each other, wherein the conductive element defines a central portion which is elongate in the direction of extent of said channel, and said flanges extend in said direction and out of a plane of the central portion to respective opposite sides of said plane and the contact portions extend from substantially fixed ends at an angle to the direction of extent of the channel and converge towards each other, said contact portions having free end parts which extend generally parallel to each other and which define said contact edges and free end edges of said free end parts extend transversely with respect to a direction of extent of said channel and diverge outwardly with respect to each other in a direction away from said substantially fixed ends to form a lead-in structure for facilitating entry of the wire into the channel.

2. An insulation displacement contact as claimed in claim 1, wherein said free edges extend angularly with respect to said plane of the central portion with a first free edge having an angular extent in one direction with respect to said plane and a second free edge oppositely directed with respect to said plane so as to introduce displacement of the contact portions in opposite directions out of said plane, when a wire is brought into contact with said free end edges for introduction into said channel.

3. An insulation displacement contact formed of a conductive element, the insulation displacement contact comprising:

an aperture provided in the conductive element and having opposed edge portions defining opposed contact portions which extend inwardly towards each other and which have inner opposed contact edges which define a channel therebetween, whereby a wire having a conductor surrounded by insulation may be introduced into the channel and pressed into the channel to cut the insulation of the wire and make electrical contact between the contact edges and the conductor;

another aperture provided in the conductive element and having further opposed edge portions defining further opposed contact portions which extend inwardly towards each other and which have further inner opposed contact edges which define another channel, whereby another wire having another conductor surrounded by insulation may be introduced into the another channel and pressed into the another channel to cut the insulation of the another wire and make electrical contact between the further inner opposed contact edges and the another conductor; and a flange at a side edge of each conductive element and another flange at an opposite side edge of each conductive element, each of said flange and said another flange generally extending in a direction parallel to the direction of extent of said channel and said flange having a direction of extend that is opposite said another flange.

4. An insulation displacement contact as claimed in claim 3, wherein each conductive element defines a central portion which is elongate in the direction of extent of said channel, and said flanges extend in said direction and out of a plane of the central portion to respective opposite sides of said plane.

5. An insulation displacement contact as claimed in claim 4, wherein each of the contact portions extend from substantially fixed ends at an angle to the direction of extent of the channel and converge towards each other, said contact portions having free end parts which extend generally parallel to each other and which define the respective said contact edges.

6. An insulation displacement contact as claimed in claim 5, wherein free end edges of each of said free end parts extend transversely with respect to a direction of extent of each respective said channel and diverge outwardly with respect to each other in a direction away from said substantially fixed ends to form a lead-in structure for facilitating entry of the wire into the channel.

7. An insulation displacement contact as claimed in claim 6, wherein said free edges extend angularly with respect to said plane of the central portion with a first free edge having an angular extent in one direction with respect to said plane and a second free edge oppositely directed with respect to said plane so as to introduce displacement of the contact portions in opposite rotational directions out of said plane, when a wire is brought into contact with said free end edges for introduction into said channel.

8. An insulation displacement contact comprising:

a conductive element having an aperture therein, opposed portions of the edge of said aperture defining first opposed contact portions which extend inwardly towards each other and which have first inner opposed contact edges which define a first channel therebetween, whereby a first wire having a conductor surrounded by insulation may be introduced into said first channel and pressed into said first channel to cut the insulation of the first wire and make electrical contact between the contact edges and the conductor and opposed portions of the edge of said aperture defining second opposed contact portions which extend inwardly towards each other and which have second inner opposed contact edges which define a second channel therebetween, whereby a second wire having another conductor surrounded by insulation may be introduced into said second channel and pressed into said second channel to cut the insulation of the second wire and make electrical contact between the contact edges and the conductor of the second wire, the insulation displacement contact having, at opposed side edges of the conductive element, respective flanges which are generally parallel to the direction of extent of each channel and which are oppositely directed with respect to each other.

9. An insulation displacement contact comprising:

a conductive element having an aperture therein, opposed portions of the edge of the aperture defining opposed contact portions which extend inwardly towards each other and which have inner opposed contact edges which define a channel therebetween, whereby a wire having a conductor surrounded by insulation may be introduced into the channel and pressed into the channel to cut the insulation of the wire and make electrical contact between the contact edges and the conductor, the insulation displacement contact having, at opposed side edges of the conductive element, respective flanges which are generally parallel to the direction of extent of said channel and said flanges extend out of a plane of the central portion and are oppositely directed with respect to each other, the contact portions having free end parts with free edges extending angularly with respect to said plane of the central portion with a first free edge having an angular extent in one direction with respect to said plane and a second free edge oppositely directed with respect to said plane so as to introduce displacement of the contact portions in opposite directions out of said plane, when a wire is brought into contact with said free end edges for introduction into said channel.

* * * * *